US005269209A

United States Patent [19]

Baker

[11] Patent Number: 5,269,209

[45] Date of Patent: Dec. 14, 1993

[54] CURVILINEAR DRIVE SCREWDRIVER AND SCREW

[76] Inventor: David R. Baker, 7254 Laurie Dr., Fort Worth, Tex. 76112

[21] Appl. No.: 963,606

[22] Filed: Oct. 20, 1992

[51] Int. Cl.[5] ..... B25B 15/02

[52] U.S. Cl. ..... 81/436; 81/186; 411/403

[58] Field of Search ..... 81/119, 121.1, 186, 81/436; 411/402–404, 407

[56] References Cited

U.S. PATENT DOCUMENTS 3,178,988 4/1965 Borup .
4,338,835 7/1982 Simons ..... 81/436
4,873,900 10/1989 Ciumaga ..... 81/436
4,889,020 12/1989 Baker .
5,088,869 2/1992 Greenslade .

*Primary Examiner*—James G. Smith
*Attorney, Agent, or Firm*—James E. Bradley

[57] ABSTRACT

A screwdriver and screw may be used in combination or with conventional screws and screwdrivers. The screwdriver has a head with forward and rearward faces. Curved driving surfaces on the faces extend from left and right side edges toward a longitudinal axis of the screwdriver. The screw has a slot with equal and opposite faces which are convex curved surfaces. The screw also has a bottom with protruding retainer lips and shoulders which extend upward along a side edge of each face for maintaining the driver in the slot. The bottom is a convex curved surface.

17 Claims, 5 Drawing Sheets

CURVILINEAR DRIVE SCREWDRIVER AND SCREW

BACKGROUND OF THE INVENTION

1. Field of the Invention

This invention relates to an improved screwdriver and screw which can be used in combination or alone, the improved screwdriver and screw having curvilinear contact surfaces which provide more contact area when engaging a screw or screwdriver.

2. Description of the Prior Art

In most conventional screws and screwdrivers, only the corners of the driver blade contact the slot. Because of the wedge shape of most blades, this contact will usually be at the top edges of the slot where there is minute surface area. The screw slot may be severely damaged at these points of contact where high forces are encountered during torque. The screwdriver may also "cam-out" or ride up and out of the screw slot because of the low surface area contact. This is especially true after the slot has been damaged.

Screwdrivers and screws are disclosed in a number of issued patents with increased surface area contact between the blade and slot. The problem with these designs is that only specially designed screwdrivers can be used to engage specially designed screws. Most of the prior art screws and screwdrivers are shaped to correspond to each other so that they are closely engaged. Use of the these screwdrivers with conventional screws or vice versa would be inadequate if not inferior.

There are other prior art patents which disclose screw slots having different constructions that can be used with conventional screwdrivers. However, these designs deal primarily with the ease of inserting the blade into the slot.

SUMMARY OF THE INVENTION

This invention consists of a screwdriver blade and screw, each having curvilinear surfaces which provide an increased contact area when engaging the other. The screw also has retaining walls and shoulders which prevent the screwdriver from sliding laterally out of the slot. The curved surfaces also increase the contact area when using conventional screwdrivers and screws. Because of this increased contact area, there is less damage to the screw and less tendency for the screwdriver to slip from the slot.

DETAILED DESCRIPTION OF THE INVENTION

Figure 1:
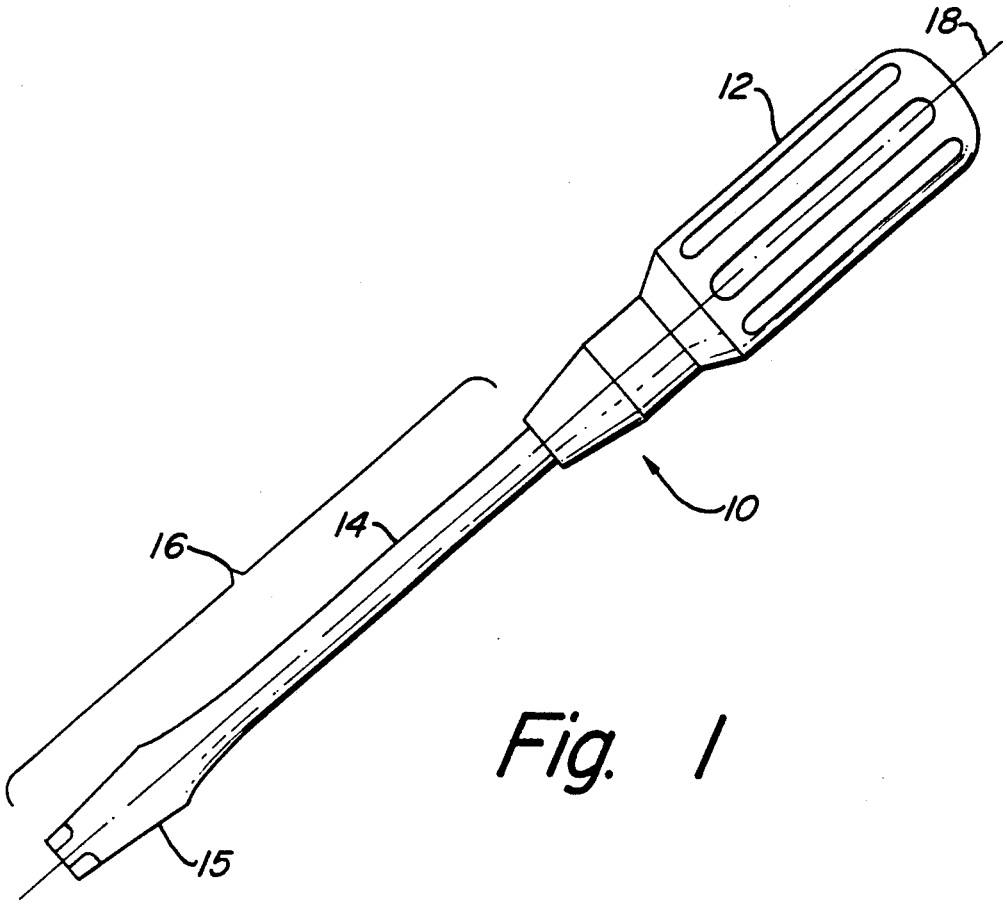
FIG. 1 is a side view of a screwdriver constructed in accordance with this invention.

FIG. 1 shows the improved screwdriver 10 of the invention. The screwdriver 10 has a handle 12. A shaft 14 is connected to the handle 12. A head 15 is integrally formed with the shaft 14 and located opposite the handle 12 on the distal end of shaft 14. The head 15 and shaft 14 constitute a blade 16. A central longitudinal axis 18 runs through the center of the screwdriver 10.

Figure 2:
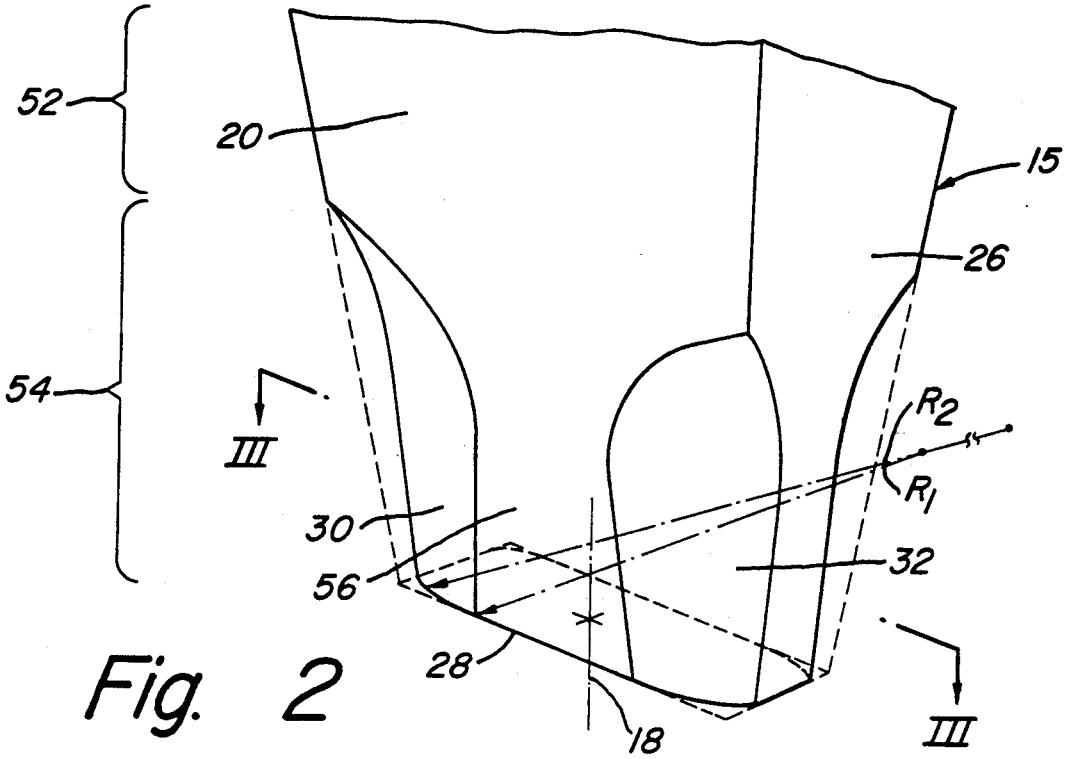
FIG. 2 is a perspective view of a portion of the screwdriver blade of FIG. 1.
Figure 3:
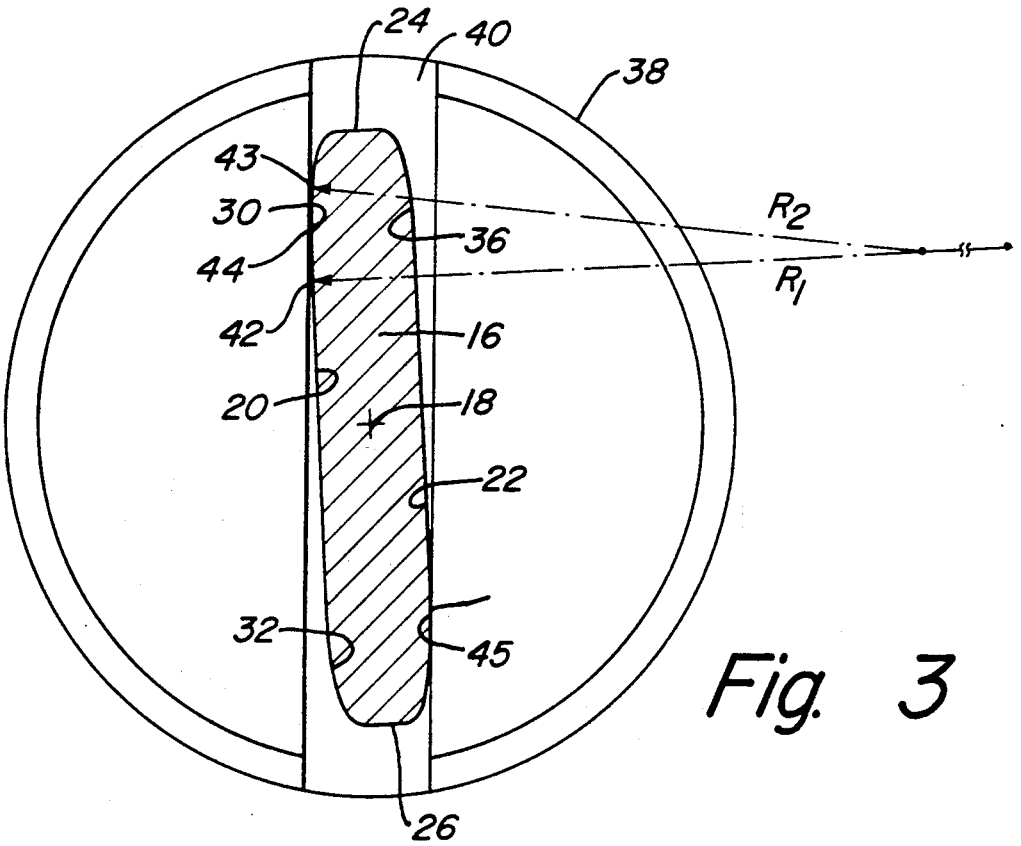
FIG. 3 is a cross sectional view of the screwdriver blade of FIG. 1, taken along the line III—III of FIG. 2, and showing the top of a conventional screw.

The head 15 has a forward face 20, shown in FIG. 2, and an Opposite facing rearward face 22, shown in FIG. 3. "Forward face" as used herein, refers to the side of head 15 that faces counterclockwise when viewed from above. The faces are joined by right side edge 24 and left side edge 26. The faces 20, 22 and edges 24, 26 terminate at a flat lower edge 28. The lower edge 28 is in a plane perpendicular to the longitudinal axis 18.

There is at least one curved drive surface 30, located on the forward face 20, which extends from the right edge 24 and curves towards the axis 18 of the screwdriver 10. Another curved drive surface 32 may also be symmetrically located on the forward face 20. The rearward face 22 also has at least one curved driving surface 34 extending from the left edge 26 and curving to the axis 18. A second curved driving surface 36 may also be symmetrically located on the rearward face 22.

The curvature on the driving surfaces 30, 32, 34, 36 is a compound curve with a continuously decreasing radius. FIG. 3 shows the driving surface 30 beginning at point 42. The curvature of the driving surface 30 has a radius R1 at point 42. At point 43, the driving surface 30 has a radius R2 which is smaller than radius R1. The radius continues to decrease until the driving surface intersects the side edge 24. The radius R1 is preferably about twenty times the thickness of the head 15 from the forward face 20 to the rearward face 22 at the lower edge 28. The radius R2 is preferably about ten times this thickness. The drive surfaces 34, 36 on rearward face 22 are identical to those of the forward face 20.

In FIG. 3, the blade 16 is shown engaging a slot 40 of a conventional screw head 38. The faces of slot 40 are parallel and flat. Because of the curvature of the driving surfaces, driving surfaces 30 and 32 contact the slot 40 at slot portions 44 and 45 during counterclockwise rotation. The driving surfaces 30, 34 are vertically parallel to the screw slot faces 44, 45 and, therefore, increase the surface-to-surface contact area, not only linearly, but over a larger planar area. During clockwise rotation, driving surfaces 32 and 36 will similarly contact the slot 40. This is an improvement over conventional screwdrivers.

Figure 4:
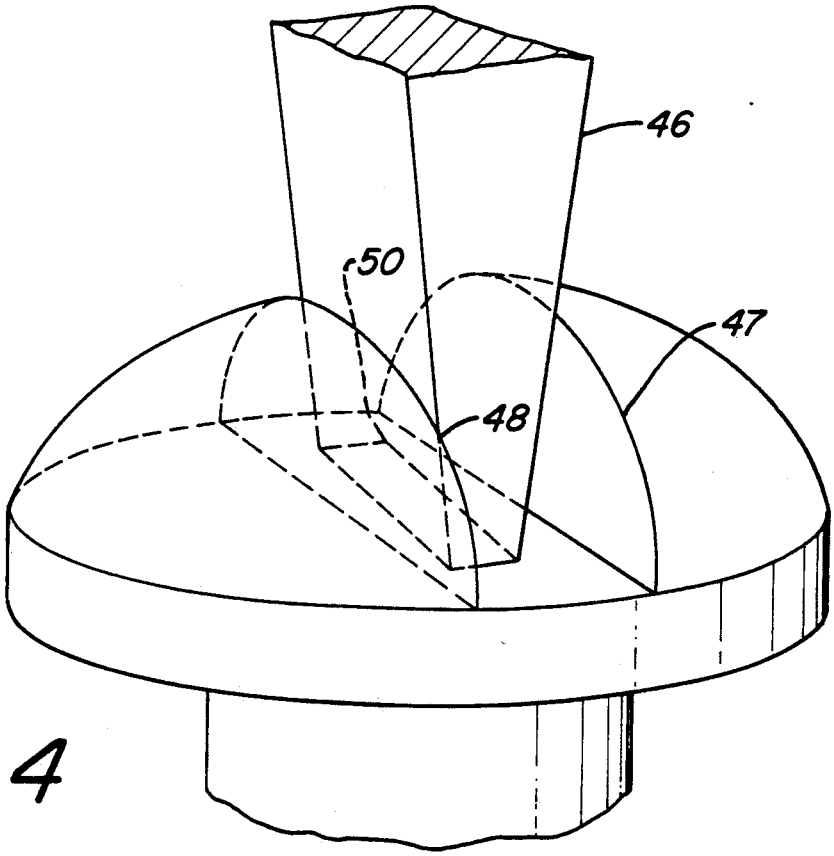
FIG. 4 is a perspective view of a prior art screwdriver blade engaging a conventional screw.

FIG. 4 shows a perspective view of a conventional wedge shaped screwdriver blade 46 in slot 40. Instead of contacting the slot 40 on the surface of the blade 46, the blade 46 only contacts the slot edge 47 at corners or points 48 and 50. During torque, points 48 and 50 will encounter extremely high forces or loads which can damage the screw slot 40. A wedge shaped or tapered blade is also more likely to "cam out" or ride up and out of the screw slot during torque. Because of the curvature of the driving surfaces 30, 32, 34, 36 of screwdriver 10, the blade 16 will engage the slot 40 not at points on the slot edge 47, but along a line of contact.

The head 15 of FIG. 2 has an upper portion 52. The upper portion 52 is located above the drive surfaces 30, 32, 34, 36. The faces 20 and 22 in upper portion 52 are flat and converge toward each other when proceeding downward away from the handle 12, providing a wedge shape. The head 15 of FIG. 2 also has a lower portion 54. A flat central section 56 is located on the lower portion 54 between the drive surfaces 30 and 32. The central section 56 is in the same plane as the face 20. Rearward face 22 will also have a corresponding flat central section, not shown, between the drive surfaces 34 and 36. The side edges 24 and 26 are also flat and converge toward each other when proceeding downward.

The lower portions of the drive surfaces 30, 36 do not converge toward each other when proceeding downward. The lower portion of the drive surfaces 32, 34 also do not converge toward each other. Rather, the thickness between drive surfaces 30 and 36 and drive surfaces 32 and 34 is substantially uniform when proceeding upward from the lower edge 22. This uniform thickness portion is greater than the depth of slot 40. This results in an axial line contact between drive surfaces 30, 34 and the points of contact 44 and 45 on slot 40, as shown in FIG. 3. The surfaces will be in contact from the bottom to the top of slot 40. This reduces "cam out" and also lessens the force applied at any single point of contact on the slot 40. This prevents slot damage that would otherwise occur.

Figure 5:
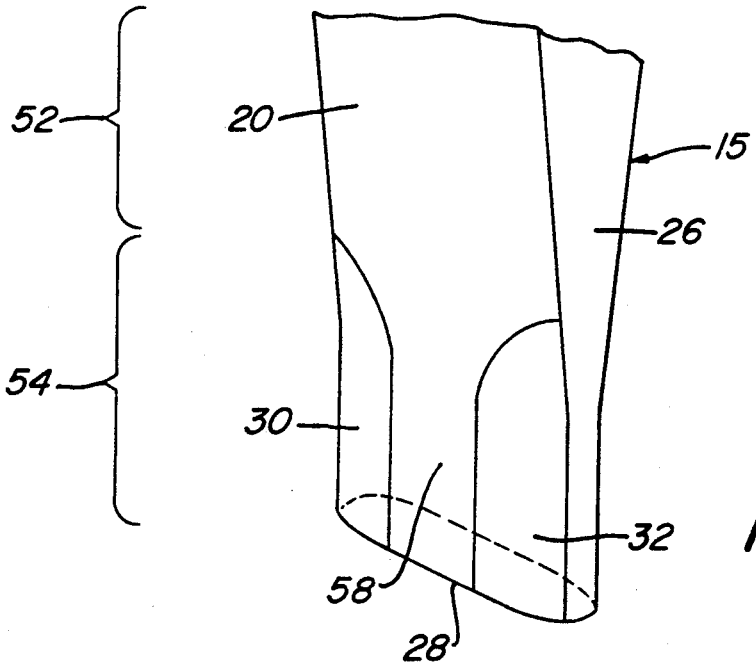
FIG. 5 is a perspective view of an alternate embodiment of a portion of a screwdriver blade constructed in accordance with this invention.

FIG. 5 shows an alternate embodiment of the head 15. The head 15 has an upper portion 52 where the faces 20 and 22 are flat and converge toward each other proceeding downward, resulting in a wedge shape. There is also a lower portion 54 which has a flat central section 58. The central section 58 is located between the drive surfaces 30 and 32. The rearward face 22 also has a similar flat central section, which is not shown, located between drive surfaces 34 and 36. The rearward and forward central section 58 are located in parallel planes which are perpendicular to the lower edge 28. The side edges 24 and 26 are also parallel to each other. Unlike head 15 of FIG. 2, the configuration is not wedge shaped. The thickness between the lower portion of drive surfaces 30 and 36 and drive surfaces 32 and 34 is also substantially uniform for at least the depth of an average slot 40.

Figure 6:
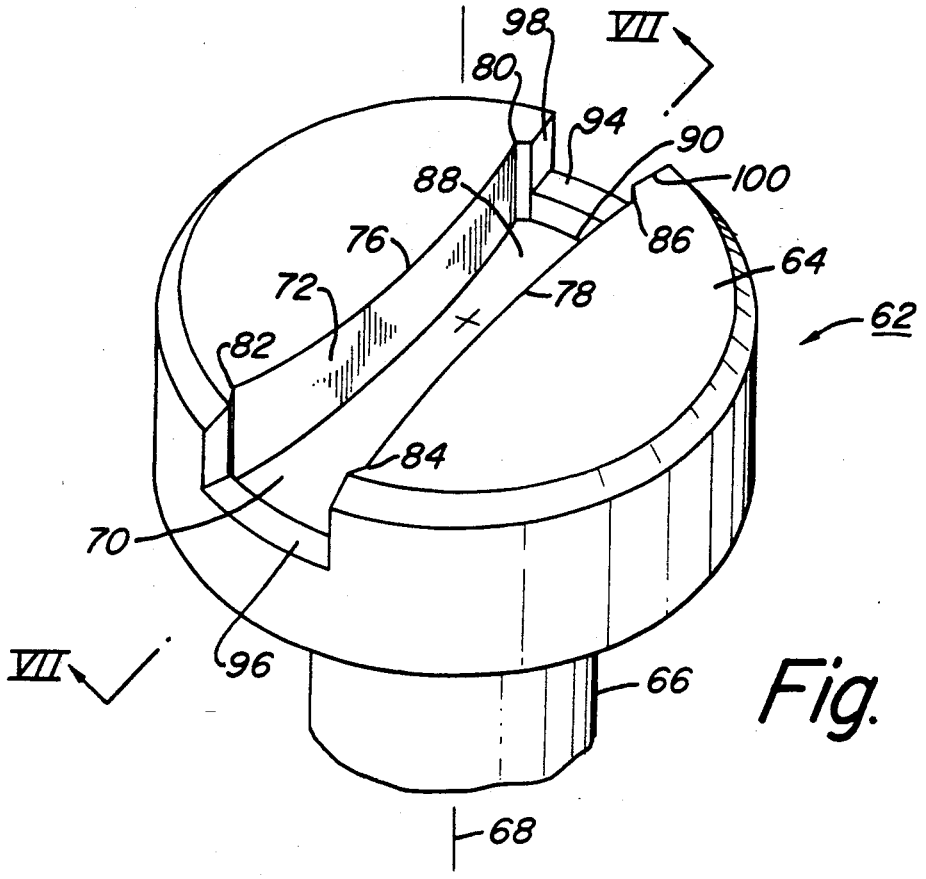
FIG. 6 is a perspective view of a portion of a screw constructed in accordance with this invention.

An improved screw 62 is shown in FIG. 6. The screw 62 has a head 64 and a threaded shank 66. A longitudinal axis 68 runs through the head 64 and shank 66.

The head 64 is divided into equal sections by a slot 70. The slot 70 has two equal and opposite facing slot faces 72 and 74. Slot face 72 is a forward face and slot face 74 is a rearward face as defined herein. The faces 72, 74 are curved convexly from the center 76, 78 of the faces 72, 74 to the side edges 80, 82, 84, 86. Side edges 80, 86 are considered right side edges and side edges 82 and 84 left side edges. The distance 78 and greatest between the side edges 80, 82, 84, and 86.

Figure 8:
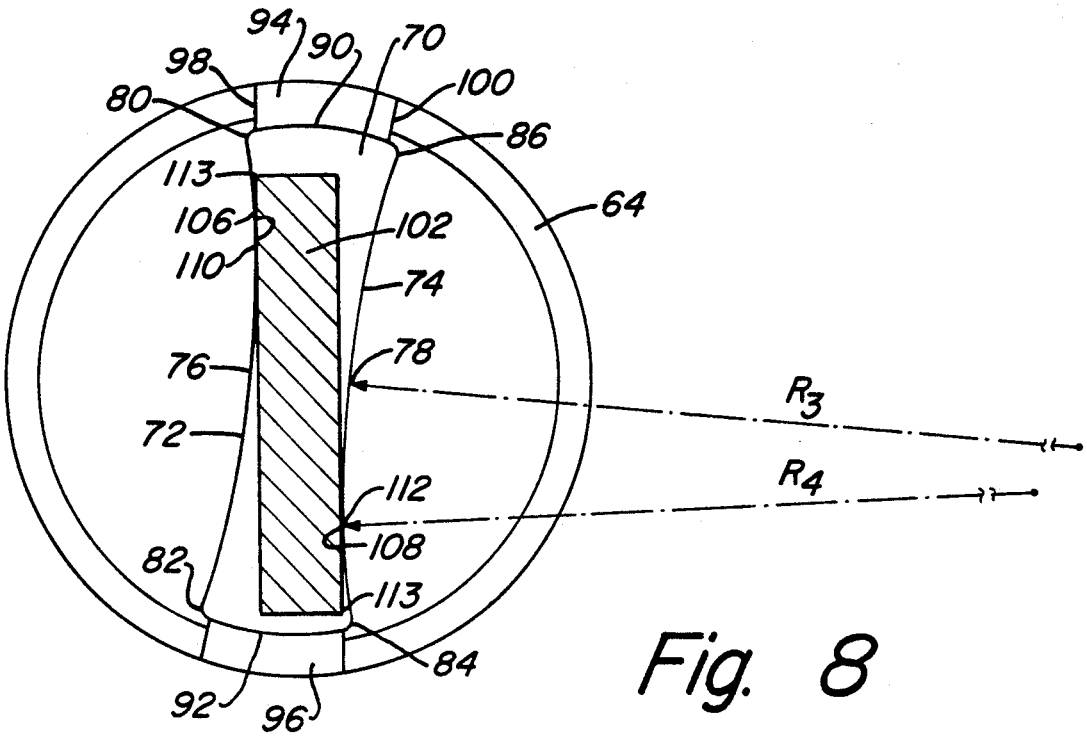
FIG. 8 is a top view of the screw of FIG. 6, showing a conventional screwdriver blade engaging the screw.

The curved faces 72, 74 have a decreasing radius of curvature from the centers 76, 78 to the side edges 80, 82, 84, 86. FIG. 8 shows radius R3 at the center 78 being greater than radius R4. Radius R3 is preferably about twenty times the width of slot 70 between centers 76, 78. Radius R4 is preferably about ten times the width of the slot 70 between centers 76, 78.

Figure 7:
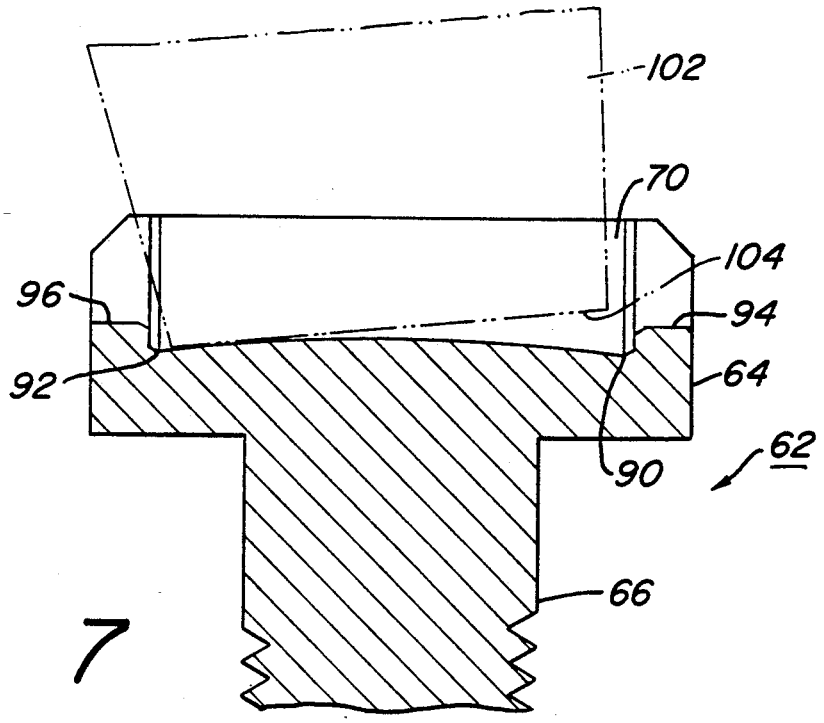
FIG. 7 is a cross sectional view of the screw of FIG. 6 taken along the lines VII—VII.

The slot 70 also has a bottom 88. The bottom 88 may be flat, but is preferably curved as shown in FIG. 7. The curvature of the bottom 88 is a convex curved surface which gradually curves from the center of slot 70 toward slot ends 90 and 92. The radius of curvature of bottom 88 is preferably twenty-five to thirty times the width of slot 70 at Centers 76, 78.

Each slot end 90, 92 has a retainer lip 94, 96 which protrudes upwards from the bottom 88 at the side edge 80, 82, 84, 86. Each retainer lip 94, 96 has shoulders 98, 100 which extend upward from the retainer lip 94, 96 and along the side edges 80, 82, 84, 86.

A cross sectional view of the conventional screwdriver blade 102 in the improved screw head 64 can be seen in FIG. 8. The flat driving surfaces 106 and 108 of the blade 102 engage portions 110 and 112 of the slot faces 72 and 74 when the blade 102 is rotated in a counterclockwise direction. Because of the curvature of the slot faces 72, 74, the corners 113 of the blade 102 do not contact the slot faces 72, 74. Rather, the contact area is a line contact with the drive surfaces 106, 108. This creates a greater area of contact between the blade 102 and the slot faces 72, 74. This reduces side slip and deformation of the screw head 64 by spreading the torque load over a larger area.

Figure 9:
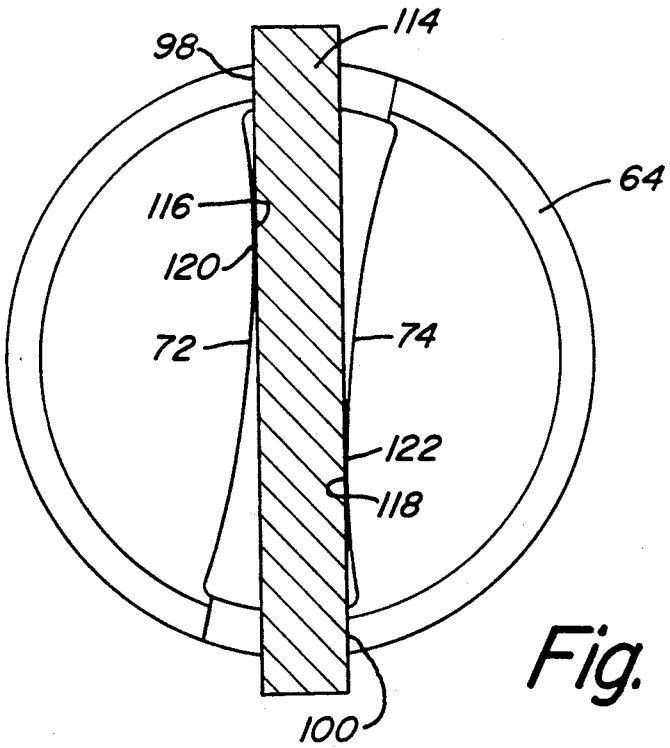
FIG. 9 is a top view of the screw of FIG. 6, showing an oversized conventional screwdriver blade engaging the screw.

FIG. 9 Shows the screw head 64 with a cross sectional view of an oversized screwdriver blade 114. Flat portions 116 and 118 of the blade 114 engage the slot portions 120 and 122 of the slot faces 72, 74. Because of the curvature of the slot faces 72, 74, the blade 114 may still maintain contact with the slot faces 72, 74 while engaging the shoulders 98 and 100.

Figure 10:
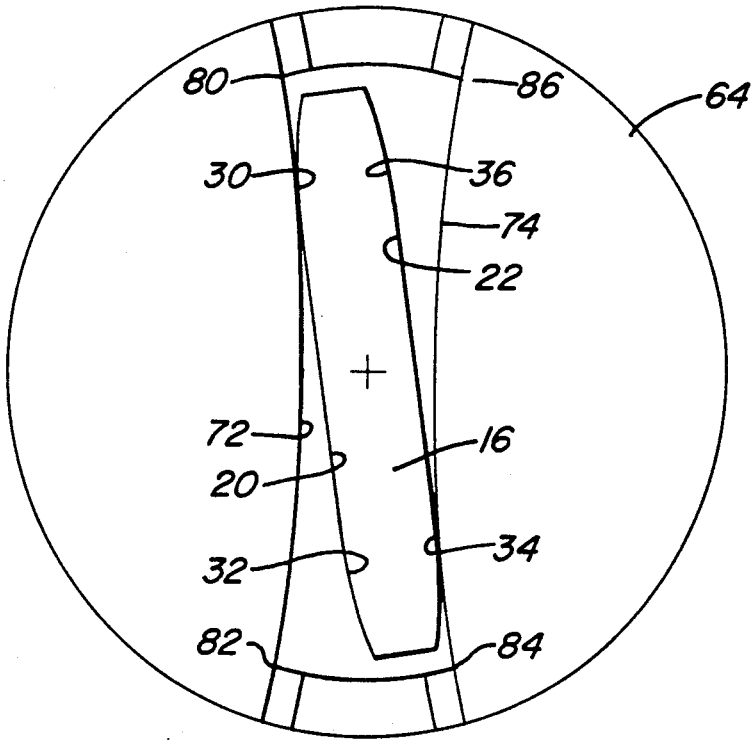
FIG. 10 shows a cross sectional view of the screwdriver blade of FIG. 1 engaging a screw of FIG. 6.

FIG. 10 shows the improved blade 16 engaging the screw head 64. During counter clockwise rotation, the driving surface 30 of the forward face 20 of the blade 16 contacts the forward face 72 of the slot 70. The driving surface 34 of the rearward face 22 of the blade 16 contacts the rearward face 74 of the slot 70. During clockwise rotation, the driving surface 32 of the forward face 20 of the blade 16 will contact the forward face 72 of slot 70. Driving surface 36 of the rearward face 22 of the blade 16 will contact the rearward face 74 of the slot 70.

The improved screwdriver 10 and screw 62 may be used with conventional screws and screwdrivers or they can be used together. When used together, the improved screwdriver 10 and screw 62 are even more effective and safer than if used alone.

When the improved screw 62 is used with a conventional screwdriver blade 102, the curved bottom 88 shown in FIG. 7 and the retainer lips 94, 96 and retainer shoulders 98, 100 have several advantages. When the blade 102 is tilted off the axis of screw head 64, there will still be considerable surface contact with the bottom 88. This helps reduce side slip. The retainer lips 94, 96 also keep the screwdriver blade 102 inside the slot when it is in a less than vertical position, regardless of whether the screwdriver is undergoing twist or torque loads. The retaining shoulders 98, 100 help to retain the blade 102 in the screw slot 70 when the blade 102 is undergoing twist or torque.

While the invention has been shown in only one of its forms, it should be apparent to those skilled in the art that it is not so limited, but is susceptible to various changes without departing from the scope of the invention.

What is claimed is:

1. A screwdriver blade for driving a screw having a head with a slot which has spaced apart faces, the screwdriver blade comprising in combination:

a shaft which has a longitudinal axis;

a head formed on the shaft, the head having a forward face, a rearward face facing opposite the forward face, the faces being joined by right and left side edges and terminating in a flat lower edge;

at least one drive surface formed on the forward face, extending from the right edge toward the axis of the shaft and being a curved surface for contact with a face of the slot of the screw;

at least one drive surface formed on the rearward face, extending from the left edge toward the axis of the shaft and being a curved surface for contact with an opposite face of the slot of the screw;

wherein there are two of the drive surfaces on the forward face, with the other of the drive surfaces extending from the left edge of the forward face toward the axis of the shaft and being a curved surface; and there are two of the drive surfaces on the rearward face, with the other of the drive surfaces extending from the right edge of the rearward face toward the axis of the shaft and being a curved surface; and further comprising a central section that is substantially flat on the forward and rearward faces between the drive surfaces on the forward and rearward faces.

2. A screwdriver blade for driving a screw having a head with a slot which has spaced apart faces, the screwdriver blade comprising in combination:

a shaft which has a longitudinal axis;

a head formed on the shaft, the head having a forward face, a rearward face facing opposite the forward face, the faces being joined by right and left side edges and terminating in a flat lower edge;

at least one drive surface formed on the forward face, extending from the right edge toward the axis of the shaft and being a curved surface for contact with a face of the slot of the screw;

at least one drive surface formed on the rearward face, extending from the left edge toward the axis of the shaft and being a curved surface for contact with an opposite face of the slot of the screw;

wherein the forward face and rearward face have an upper portion, located above the drive surfaces, which are flat surfaces, the flat surfaces converging toward each other in a downward direction; and the drive surfaces are located on a lower portion of the forward and rearward faces, the lower portion of the forward and rearward faces having flat surfaces which are located in parallel planes.

3. A screwdriver blade for driving a screw having a head with a slot which has spaced apart faces, the screwdriver blade comprising in combination:

a shaft which has a longitudinal axis;

a head formed on the shaft, the head having a forward face, a rearward face facing opposite the forward face, the faces being joined by right and left side edges and terminating in a flat lower edge;

at least one drive surface formed on the forward face, extending from the right edge toward the axis of the shaft and being a curved surface for contact with a face of the slot of the screw;

at least one drive surface formed on the rearward face, extending from the left edge toward the axis of the shaft and being a curved surface for contact with an opposite face of the slot of the screw;

wherein the forward face and rearward face have an upper portion, located above the drive surfaces which are flat surfaces, the flat surfaces converging toward each other in a downward direction; and the drive surfaces are located on a lower portion of the forward and rearward faces, the lower portion of the forward and rearward faces having flat surfaces which converge toward each other in a downward direction.

4. A screwdriver blade for driving a screw having a head with a slot comprising in combination:

a shaft which has a longitudinal axis;

a head formed on the shaft, the head having a forward face, a rearward face facing opposite the forward face, the faces being joined by right and left side edges and terminating in a flat lower edge, the forward face and rearward face have an upper portion and a lower portion, the upper portion being flat surfaces, the flat surfaces converging toward each other in a downward direction;

two drive surfaces on the lower portion of the forward face, one drive surface extending from the right edge toward the axis of the shaft, the other of the drive surfaces extending from the left edge of the forward face toward the axis of the shaft, each drive surface having a curvature, the curvature being a compound curve having a greater radius near the axis than at the side edge, for contact with one of the faces of the slot of the screw;

two drive surfaces on the lower portion of the rearward face, one drive surface extending from the right edge toward the axis of the shaft, the other of the drive surfaces extending from the left edge of the forward face toward the axis of the shaft, each drive surface having a curvature, the curvature being a compound curve having a greater radius near the axis than at the side edge, for contact with the other of the faces of the slot of the screw; and a central section on the lower portion of the forward and rearward faces between the drive surfaces that is substantially flat.

5. The screwdriver blade of claim 4, wherein:

the flat surfaces on the central section of the lower portion of the forward and rearward faces are located in parallel planes.

6. The screwdriver blade of claim 4, wherein:

the flat surfaces on the central section of the lower portion of the forward and rearward faces are located in planes which converge toward each other in a downward direction.

7. In a screwdriver blade and screw, wherein the screwdriver blade has a shaft having a longitudinal axis and a head located on the shaft, the head of the screwdriver having forward and rearward faces joined by right and left side edges, the screw having an axis, a head with a slot having forward and rearward faces and right and left side edges for engagement by the forward and rearward faces of the head of the screwdriver, respectively, the improvement comprising:

at least one curved drive surface formed on one of the forward faces, extending from a right edge toward a central portion of said one of the forward faces;

at least one curved drive surface formed on one of the rearward faces, extending from a left edge toward a central portion of said one of the rearward faces;

wherein the forward face and rearward face of the head of the screwdriver have an upper portion, located above the drive surfaces, which are flat surfaces, the flat surfaces in the upper portion converging toward each other in a downward direction; and the drive surfaces of the head of the screwdriver are located on a lower portion of the forward and rearward faces, the lower portion of the forward and rearward faces of the screwdriver having flat surfaces which are located between the drive surfaces and which are in parallel planes.

8. A screw comprising in combination:

a threaded shank;

a head integrally formed with the shank having a central longitudinal axis which runs through the shank and head, the head having a slot dividing the head into equal sections for receiving a screwdriver; and the slot having equal and opposite faces, a bottom, and two ends, each face having two side edges, each located at one of the ends of the slot, the faces each being a convex curved surface which gradually curves towards the side edges so that the distance between the faces is smallest at the center of the slot and greatest at the side edges.

9. The screw of claim 8, wherein:

the curved surface of each of the faces has a decreasing radius from the center of the face to the side edges.

10. The screw of claim 8, wherein:

the bottom of the slot is a convex curved surface which curves towards the ends of the slot.

11. The screw of claim 10, wherein:

the curved surface of the bottom has a decreasing radius from the center of the slot to the ends of the slot.

12. The screw of claim 8, further comprising:

a retainer lip located at each end of the slot which protrudes upwards from the bottom.

13. The screw of claim 8, further comprising:

retainer shoulders at each end of the slot which extend upward from the bottom of the slot along the side edges of the faces.

14. A screw comprising in combination:

a threaded shank;

a head integrally formed with the shank having a central longitudinal axis which runs through the shank and head, the head having a slot dividing the head into equal sections for receiving a screwdriver;

the slot having equal and opposite faces, a bottom, and two ends, each face having two side edges, one at each end of the slot, the faces each being a convex curved surface which gradually curves towards the side edges, so that the distance between the faces is smallest at the center of the slot and greatest at the side edges, the bottom of the slot being a convex curved surface which curves towards the ends of the slot; and a retainer lip located at each end of the slot which protrudes upwards from the bottom.

15. The screw of claim 14, wherein:

the curved surface of the face has a decreasing radius from the center of the face to the side edges.

16. The screw of claim 14, wherein:

the curved surface of the bottom has a decreasing radius from the center of the slot to the ends of the slot.

17. The screw of claim 14, further comprising:

retainer shoulders which extend upward from the retainer lip and along the side edges of the faces.

* * * * *